United States Patent [19]

King

[11] Patent Number: 4,714,120

[45] Date of Patent: Dec. 22, 1987

[54] DIAMOND DRILL BIT WITH CO-JOINED CUTTERS

[75] Inventor: William W. King, Houston, Tex.

[73] Assignee: Hughes Tool Company, Houston, Tex.

[21] Appl. No.: 42,546

[22] Filed: Apr. 23, 1987

Related U.S. Application Data

[63] Continuation of Ser. No. 823,706, Jan. 29, 1986, abandoned.

[51] Int. Cl.[4] ..... E21B 10/46

[52] U.S. Cl. ..... 175/329; 175/409

[58] Field of Search ..... 175/329, 409, 410, 411, 175/412, 413, 400; 76/108 A

[56] References Cited

U.S. PATENT DOCUMENTS

| | | | |
|---|---|---|---|
| 3,127,944 | 4/1964 | Davis | 175/329 |
| 3,938,599 | 2/1976 | Horn | 175/329 |
| 4,073,354 | 2/1978 | Rowley et al. | 175/329 |
| 4,098,363 | 7/1978 | Rohde et al. | 175/329 |
| 4,244,432 | 1/1981 | Rowley et al. | 175/329 |
| 4,246,977 | 1/1981 | Allen | 175/329 |
| 4,460,053 | 7/1984 | Jurgens et al. | 175/329 |
| 4,499,958 | 2/1985 | Radtke et al. | 175/329 |
| 4,577,706 | 3/1986 | Barr | 175/393 X |

*Primary Examiner*—Stephen J. Novosad
*Assistant Examiner*—David J. Bagnell
*Attorney, Agent, or Firm*—Charles D. Gunter, Jr.

[57] ABSTRACT

An earth boring bit is shown having a body with one end which is connected to a drill string member for rotation and having an opposite end with a matrix formed thereon. A plurality of cutting elements are mounted on the matrix for dislodging geological formations. The cutting elements include groups of at least two but less than four cutters which are co-joined by a common backing of the matrix, the co-joined groups being spaced-apart from adjacent co-joined groups mounted on the matrix.

2 Claims, 6 Drawing Figures

Fig.3
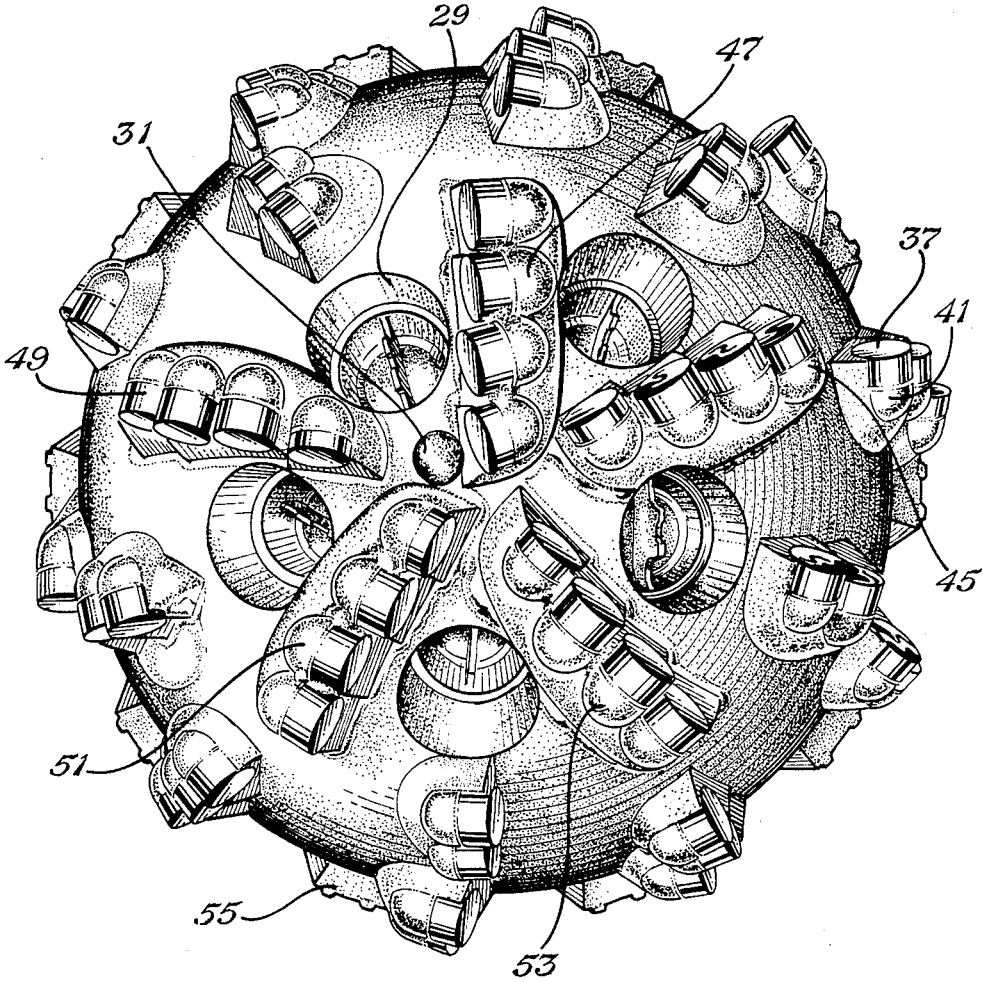
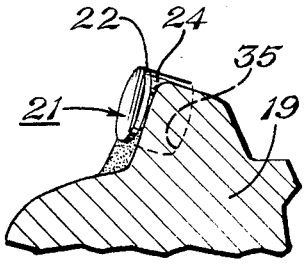
Fig. 4
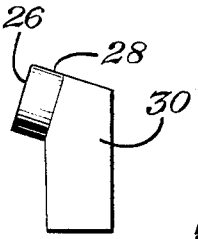
Fig. 5
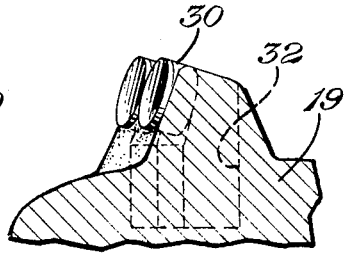
Fig. 6

DIAMOND DRILL BIT WITH CO-JOINED CUTTERS

This application is a continuation of application Ser. No. 823,706, filed Jan. 29, 1986, now abandoned.

BACKGROUND OF THE INVENTION

1. Field of the Invention

This invention relates in general to earth boring bits, particularly to those utilizing diamonds for cutting elements used to disintegrate geological formations.

2. Description of the Prior Art

Commercially available earth boring bits can be generally divided into the rolling cutter bits, having either steel teeth or tungsten carbide inserts, and diamond bits, which utilize either natural diamonds or artificial or man-made diamonds. The artificial diamonds are "polycrystalline", used either individually or as a component of a composite compact or insert on a cemented tungsten carbide substrate. Recently, a new artificial, polycrystalline diamond has been developed which is stable at higher temperatures than the previously known polycrystalline diamond. Both types of polycrystalline diamond are available in a wide variety of shapes and sizes.

The diamond earth boring bits can be generally classified as either steel bodies bits or matrix bits. The steel bodied bits are machined from a steel block and typically have cutting elements which are press-fit into recesses provided in the bit face. The matrix bit is formed by coating a hollow tubular steel mandrel in a casting mold with metal bonded hard material, such as tungsten carbide. The casting mold is of a configuration which will give a bit of the desired form. The cutting elements are typically either polycrystalline diamond compact cutters brazed within a recess provided in the matrix backing or are thermally stable polycrystalline diamond cutters which are cast within recesses provided in the matrix backing.

Placement of the cutter elements on the bit face of matrix bits has fallen into two general schemes. In the first of these, the cutters are placed in a straight row extending from a central location on the bit face out to the full bit diameter. The performance of these bits is sometimes limited by the fact that cuttings dislodged at the center of the bit face must move in a straight line down the cutting blade before exiting the bit face. There is a tendency for cuttings to collect on the bit face and restrict fluid flow across the bit face. In addition, cuttings from the bit center are reground along the entire length of the blade, accelerating wear.

In the second scheme, cutters are set in individual mountings placed strategically around the bit face. These bits are disadvantaged by the fact that individual cutter mounts are more susceptible to gross failure by shearing.

SUMMARY OF THE INVENTION

It is the general object of the invention to provide an earth boring drill bit with co-joined cutters mounted on the bit face so as to offer increased resistance to gross failure by shearing without interfering with the flow of fluid and entrained cuttings exiting the bit face.

Accordingly, an earth boring drill bit is provided having one end that includes means for connection to a drill string member, and having a matrix formed on the opposite end with a plurality of cutting elements mounted thereon. The cutting elements include groups of at least two but less than four cutters which are co-joined by a common backing of the matrix, the co-joined groups being spaced-apart from adjacent co-joined groups mounted on the matrix.

The above as well as additional objects, features and advantages of the invention will become apparent in the following description.

BRIEF DESCRIPTION OF THE DRAWINGS

FIG. 3 is a head-on view of the bit face of the earth boring bit of FIG. 1, showing the placement of the cutting elements thereon.

FIG. 4 is a simplified, side view of one type of cutting element mounted on the bit face.

FIG. 5 is a side, isolated view of another type cutting element.

FIG. 6 is a simplified, side view of the cutting element of FIG. 5 mounted on the bit face.

DESCRIPTION OF THE PREFERRED EMBODIMENT

Figure 1:
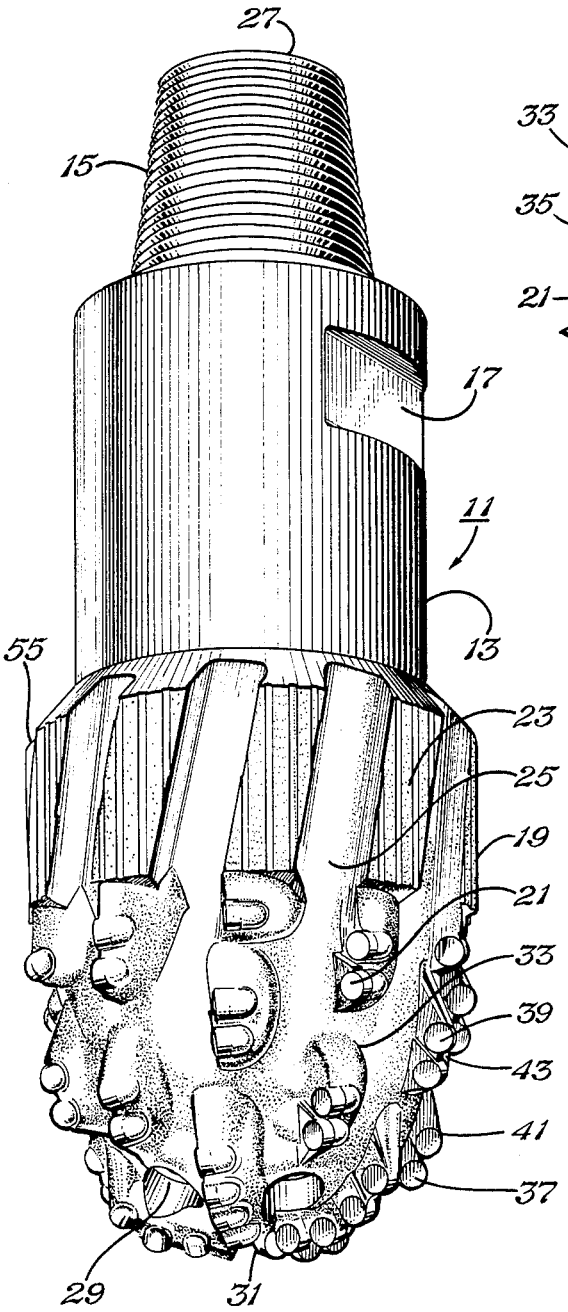
FIG. 1 is a perspective view as seen looking from the side of an earth boring bit embodying the principles of my invention.

The numeral 11 in the drawing designates an earth boring bit having a body 13 with a threaded shank 15 formed on one end for connection with a drill string member (not shown). The body 13 further includes a pair of wrench flats 17 used to apply the appropriate torque to properly "make-up" the threaded shank 15. The body 13 has a tubular bore 27 which communicates with the interior of the drill string member, and which communicates by internal fluid passageways (not shown) with one or more fluid openings 29 which are used to circulate fluids to the bit face.

On the opposite end of the bit body 13, there is formed a bit head or "matrix" 19 in a predetermined configuration to include cutting elements 21, longitudinally extending lands 23, and fluid courses or channels 25. The matrix 19 is of a composition of the same type used in conventional diamond matrix bits, one example being that which is disclosed in U.S. Pat. No. 3,175,629 to David S. Rowley, issued Mar. 30, 1965. Such matrices can be, for example, formed of copper-nickel alloy containing powdered tungsten carbide.

Matrix head bits of the type under consideration are manufactured by casting the matrix material in a mold about a steel mandrel. The mold is first fabricated from graphite stock by turning on a lathe and matching a negative of the desired bit profile. Cutter pockets are then milled in the interior of the mold to the proper contours and dressed to define the position and angle of the cutters. The fluid channels and internal fluid passageways are formed by positioning a temporary displacement material within the interior of the mold which will later be removed.

A steel mandrel is then inserted into the interior of the mold and the tungsten carbide powders, binders and flux are added to the mold. The steel mandrel acts as a ductile core to which the matrix material adheres during the casting and cooling stage. After firing the bit in a furnace, the mold is removed and the cutters are mounted on the exterior bit face within recesses in or receiving pockets of the matrix.

The bit head 19 in FIG. 1 has a ballistic or "bullet-shaped" profile which is generally conical in cross-section and which converges to a central nose location 31 on the bit face. The backings 33 for the cutting elements 21 are portions of the matrix which protrude outwardly from the face of the bit and which are formed with cutter receiving pockets or recesses 35 during the casting operation.

As shown in FIG. 4, the cutting elements 21 are of a hard material, preferably polycrystalline diamond composite compacts, referred to hereafter as PDC's. Such cutting elements are formed by sintering a polycrystalline diamond layer 22 to a tungsten carbide substrate 24 and are commercially available to the drilling industry from General Electric Company under the "STRATA-PAX" trademark. The PDC is then preferably mounted in the recess 35 provided in the matrix 19 by brazing the PDC within the recess. The preferred cutting elements (21 in FIG. 4) are generally cylindrical.

FIG. 5 shows another type of cutting element which can be mounted on the bit face. The cutting element 26 is formed by sintering a polycrystalline diamond layer 26 to a tungsten carbide substrate 28 which is bonded to a tungsten carbide stud 30 which is then preferably mounted into a recess (32 in FIG. 6) provided in the matrix 19 by brazing, welding, cementing, or press fitting. U.S. Pat. No. 4,539,018 to Whanger et al., issued Sept. 3, 1985, shows a method for manufacturing this type of stud mounted cutter.

The new thermally stable polycrystalline artificial diamond useful as cutting elements in the invention are currently being sold by General Electric Company under the "GeoSet" trademark. These cutters are available in cylindrical shapes and can be cast in place of the bit face in recesses similar to recess 35 in FIG. 4.

Figure 2:
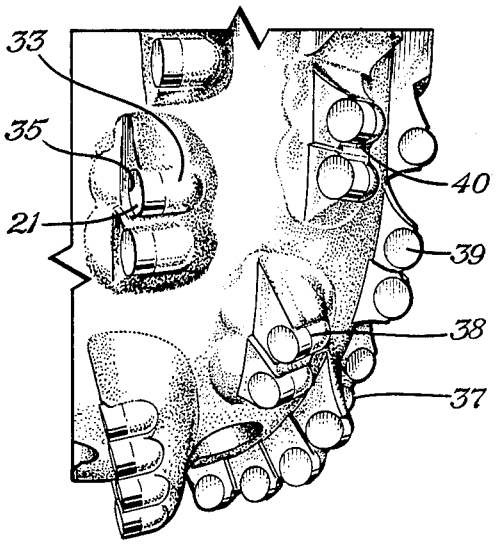
FIG. 2 is a close-up, fragmentary side view of the bit head, showing the preferred cutting elements

As shown in FIGS. 1–3, the bit of the invention has cutting elements which include groups of at least two but less than four cutters, such as the groups 37 and 39 in FIG. 1, which are co-joined by a common backing 41, 43 of the matrix. Preferably, the co-joined groups include pairs of cutters which are co-joined by a common backing. The distance between the cutters in a co-joined cutting group ranges from about 0.010 inches to a maximum of about one half the diameter of one of the cutters in the cutting group. The co-joined groups are themselves spaced-apart from adjacent co-joined groups mounted on the face of the bit to improve the flow of fluid and entrained cuttings exiting the bit face. The co-joined groups radiate outwardly from the central location 31 generally along the bit face in the direction of the gage portion 55.

As shown in FIG. 3, the bit face can be provided with a plurality of cutter blades 45, 47, 49, 51, 53 comprised of at least four cutters joined by a common backing. The cutter blades 45–53 are mounted on the bit face adjacent the fluid openings 29 and extend radially on the bit face from the central location 31 in the direction of the bit gage portion 55. The cutter blades 45–53 do not extend the entire distance to the gage portion 55, however. The pairs of co-joined cutters are located in the region of the bit face between the cutter blades 45–53 and the gage portion 55. The co-joined pairs, i.e. pair 38 in FIG. 2, are spaced-apart from adjacnt co-joined pairs, i.e. pair 40, and from the cutter blades.

The use of co-joined cutters which share a common backing of the matrix provide several advantages. The co-joined cutters improve the strength of the cutting elements and resist shearing. Because traditional full-length blades are not utilized, cuttings can swirl across the bit face without causing a build-up or forming a dam. Improved fluid flow over the bit face is achieved without decreasing the resistance of the cutting elements to shearing and failure.

While the invention has been shown in only one of its forms, it is not thus limited but is susceptible to various changes and modifications without departing from the spirit thereof.

I claim:

1. An earth boring bit, comprising:

a body including a metallic shank on one end with a tubular bore and with means for connection to a drill string member and rotation about a longitudinal axis;

a cast matrix bonded to the metallic shank and forming a face of the bit, the bit face having a plurality of cutting elements mounted within backings of the matrix and extending radially on the bit face from a central location to an outermost gage portion, the cutting elements having cutting surfaces for dislodging geological formations;

at least one fluid opening communicating the bit face with the tubular bore of the bit for circulating fluids to the bit face; and wherein the cutting elements are arranged in groupings, the groupings including a plurality of cutter blades comprised of at least four cutters joined by a common backing, the cutter blades being mounted on the bit face adjacent the fluid opening and extending radially on the bit face from the central location in the directon of the gage portion but terminating short of the gage portion, the groupings on the bit face also being provided as pairs of cutters which are co-joined by a common backing of the matrix, the co-joined pairs being spaced-apart radially and circumferentially from adjacent co-joined pairs and from the cutter blades, the bit groupings on the bit face further being characterized in that none of the groupings extend from the central location completely to the outermost gage portion, so that fluid circulated through the fluid opening to the face of the bit can pass through the spaces defined between the groupings of cutters in an unchanneled fashion.

2. An earth boring bit which reduces the regrinding of abrasive cuttings during drilling, comprising:

a body including a metallic shank on one end with a tubular bore and with means for connection to a drill string member and rotation about a longitudinal axis;

a cast matrix bonded to the metallic shank and forming a ballistic, conical-shaped face of the bit, the bit face having a plurality of cutting elements mounted within backings of the matrix which protrude outwardly from the face of the bit and which extend substantially radially on the bit face from a central location to an outermost gage portion, the cutting elements having cutting surfaces for dislodging geological formations;

at least one fluid opening communicating the bit face with the tubular bore of the bit for circulating fluids to the bit face; and wherein the cutting elements are arranged in groupings, the groupings including a plurality of cutter blades none of which include more than four cutters joined by a common backing, the cutter blades being mounted on the bit face adjacent the fluid opening and extending radially on the bit face from the central location in the direction of the gage portion but terminating short of the gage portion, the groupings on the bit face also being provided as pairs of cutters which are co-joined by a common backing of the matrix, the co-joined pairs being spaced-apart radially and circumferentially from adjacent co-joined pairs and from the cutter blades, the bit groupings on the bit face further being characterized in that none of the groupings extend from the central location completely to the outermost gage portion, so that fluid circulated through the fluid opening to the face of the bit can pass through the spaces defined between the groupings of cutters and travel in unchanneled fashion in the direction of the gage portion.

* * * * *